US008451207B2

(12) United States Patent
Cho et al.

(10) Patent No.: US 8,451,207 B2
(45) Date of Patent: May 28, 2013

(54) DISPLAY DRIVE CIRCUIT AND DRIVE METHOD

(75) Inventors: Hyun Ho Cho, Incheon-si (KR); Hyun Ja Cho, Cheongju-si (KR); Joon Ho Na, Daejeon-si (KR); Dae Seong Kim, Daejeon-si (KR); Dae Keun Han, Daejeon-si (KR)

(73) Assignee: Silicon Works Co., Ltd., Daejeon-Si (KR)

( * ) Notice: Subject to any disclaimer, the term of this patent is extended or adjusted under 35 U.S.C. 154(b) by 350 days.

(21) Appl. No.: 12/997,847

(22) PCT Filed: May 22, 2009

(86) PCT No.: PCT/KR2009/002693

§ 371 (c)(1),
(2), (4) Date: Dec. 13, 2010

(87) PCT Pub. No.: WO2009/154355

PCT Pub. Date: Dec. 23, 2009

(65) Prior Publication Data

US 2011/0164020 A1 Jul. 7, 2011

(30) Foreign Application Priority Data

Jun. 19, 2008 (KR) ..... 10-2008-0057606

(51) Int. Cl.
*G09G 3/36* (2006.01)

(52) U.S. Cl.
CPC ..... *G09G 3/3685* (2013.01)
USPC ..... 345/98; 345/100

(58) Field of Classification Search
CPC ..... G09G 3/3685
USPC ..... 345/98–100
See application file for complete search history.

(56) References Cited

U.S. PATENT DOCUMENTS

| | | | | |
|---|---|---|---|---|
| 6,559,824 | B1 * | 5/2003 | Kubota et al. | 345/100 |
| 7,133,015 | B1 * | 11/2006 | Yoshida et al. | 345/99 |
| 2006/0181498 | A1 * | 8/2006 | Toyozawa et al. | 345/98 |
| 2007/0195052 | A1 * | 8/2007 | Oh et al. | 345/100 |

FOREIGN PATENT DOCUMENTS

| | | | |
|---|---|---|---|
| JP | 2007-310420 | A | 11/2007 |
| KR | 10-2004-0013961 | A | 2/2004 |
| KR | 10-2005-0003752 | A | 1/2005 |
| KR | 10-2006-0119749 | A | 11/2006 |
| KR | 10-2007-0001475 | A | 1/2007 |

OTHER PUBLICATIONS

International Search Report, Appln No. PCT/ KR2009/002693, dated Feb. 2, 2010. Written Opinion of the International Searching Authority, Appln No. PCT/ KR2009/002693, dated Feb. 2, 2010.

* cited by examiner

*Primary Examiner* — Kevin M Nguyen
(74) *Attorney, Agent, or Firm* — Kile Park Reed & Houtteman PLLC

(57) ABSTRACT

A display driving circuit and method is capable of minimizing the residual image of a display panel as well as consumption electric current. The display driving circuit generates driving signals corresponding to valid data and black data and transmits the driving signals to a display panel, and includes N data selection switches (where N is the integer), N buffers, N buffer output selection switches, and multiple charge sharing switches. The N data selection switches select one of the valid data and the black data. The N buffers buffer the signal selected by the respective data selection switches. The N buffer output selection switches switch outputs of the buffers to output the respective driving signals. The multiple charge sharing switches connect the neighboring pairs of the driving signals.

12 Claims, 8 Drawing Sheets

(PRIOR ART)

(PRIOR ART)

(PRIOR ART)

DISPLAY DRIVE CIRCUIT AND DRIVE METHOD

BACKGROUND OF THE INVENTION

1. Field of the Invention

The present invention relates to a display driving circuit and method, and, more particularly, to a display driving circuit and method capable of minimizing the residual image on a display panel as well as current consumption.

2. Description of the Related Art

Generally, liquid crystal display driving circuits and driving systems have used a technique of inserting black data into a liquid crystal display in order to remove a residual image on the liquid crystal display. The technique of inserting the black data and then driving valid data to remove the residual image on the liquid crystal display has a disadvantage in that current consumption greatly increases when the black data is inserted. In contrast, a technique of driving the valid data and then inserting the black data also has a disadvantage in that the electric current consumption greatly increases when the valid data is driven.

Here, the valid data means image data that is applied to a liquid crystal display panel to be actually realized, and the black data means data that is applied to remove a residual image effect occurring on the liquid crystal display panel.

FIG. 1 shows the voltage of the data applied to a continuous horizontal line in the technique of inserting black data and then driving valid data.

Referring to FIG. 1, when the i-th horizontal line ith of a liquid crystal display is activated, black data is inserted first, and then valid data is inserted. The next (i+1)-th horizontal line (i+1)th is activated in such a manner that black data is inserted and then valid data is driven. At this time, the polarities of the voltages applied to continuous horizontal lines are continuously changed. Although the valid data to be applied to the two subsequent horizontal lines have the same size, since the polarities of the voltages are reversed, the voltage corresponding to the i-th black data is depicted as it increases, and the voltage corresponding to the next (i+th) black data is depicted as it decreases.

In the case where the black data is inserted and then the valid data is driven so as to remove the residual image, current consumption increases through a quadrangular section indicated by a dotted-line when the black data is inserted. The insertion of the black data means that electric charges corresponding to the black data are charged into a corresponding pixel. Thus, while the electric charges are charged into the pixel (as indicated by the quadrilateral dotted-line), the electric current increases.

FIG. 2 shows the voltage of the data applied to a continuous horizontal line in the technique of driving valid data and then inserting black data.

Referring to FIG. 2, in order to remove the residual image, if the valid data is driven to than insert the black data, a current consumption rise section indicated by a quadrilateral dotted-line occurs when the valid data is driven.

FIG. 3 shows a technique of inserting black data using internal output buffers of a liquid crystal display driving circuit.

Referring to FIG. 3, the liquid crystal display driving circuit 300 includes multiple output buffers 301 to 304 installed thereinside, and multiple data selection switches $SW_1$ to $SW_N$ connected to input stages of the respective output buffers 301 to 304, wherein the output buffers output signals output#1 to output#N to drive corresponding pixels (not shown), and each data selection switch switches one of valid data and black data.

FIG. 4 shows a technique of inserting black data using external output buffers of a liquid crystal display driving circuit.

Referring to FIG. 4, the liquid crystal display driving circuit 400 includes multiple output buffers 401 to 404 installed thereoutside and outputting signals output#1 to output#N to drive corresponding pixels (not shown), and multiple valid data selection switches $SW_{11}$ to $SW_{1N}$, input terminals of which are connected to output stages of the respective output buffers 401 to 404. Here, the output buffers. The other output terminals of the respective valid data selection switches $SW_{11}$ to $SW_{1N}$ are connected to output terminals of respective black data selection switches $SW_{21}$ to $SW_{2N}$, through the other input terminals of which black data is supplied. Although not shown in FIG. 4, the black data may be replaced by direct current (DC) supply voltage.

Referring to FIGS. 1 through 4, it can be seen that, if the black data is inserted to then drive the valid data, the current consumption considerably increases when the black data is driven, and that, if the valid data is driven to then insert the black data, the current consumption also considerably increased when the valid data is driven.

In the case of semiconductor chips, high consumption power results in increasing temperature of the chip, which not only increases electric current consumption but also reduces a lifespan of the chip.

SUMMARY OF THE INVENTION

Accordingly, the present invention has been made keeping in mind the above problems occurring in the related art, and embodiments of the present invention provide a display driving circuit capable of minimizing the residual image of a display panel as well as consumption electric current.

Embodiments of the present invention also provide a display driving method capable of minimizing the residual image of a display panel as well as consumption electric current.

According to an aspect of the present invention, there is provided a display driving circuit that generates driving signals corresponding to valid data and black data and transmits the driving signals to a display panel, the display driving circuit including: N data selection switches selecting one of the valid data and the black data (where N is the integer); N buffers buffering the signal selected by the respective data selection switches; N buffer output selection switches switching outputs of the buffers to output the respective driving signals; and multiple charge sharing switches connecting the neighboring pairs of the driving signals.

According to another aspect of the present invention, there is provided a display driving circuit that generates driving signals corresponding to valid data and black data and transmits the driving signals to a display panel, the display driving circuit including: N buffers buffering the valid data (where N is the integer); N buffer output selection switches switching outputs of the buffers to output the respective driving signals; N black data selection switches switching the black data output the respective driving signals; and multiple charge sharing switches connecting the neighboring pairs of the driving signals.

According to yet another aspect of the present invention, there is provided a display driving method that generates driving signals corresponding to valid data and black data and transmits the driving signals to a display, the display driving method including a valid data inserting step of transferring the driving signal corresponding to the valid data to the display; a charge sharing step of sharing charged electric charges to at least two pixels; and a black data inserting step of transferring the driving signal corresponding to the black data to the display.

BRIEF DESCRIPTION OF THE DRAWINGS

The above and other objects, features and advantages of the present invention will be more clearly understood from the following detailed description when taken in conjunction with the accompanying drawings, in which.

DETAILED DESCRIPTION OF THE INVENTION

Figure 1:
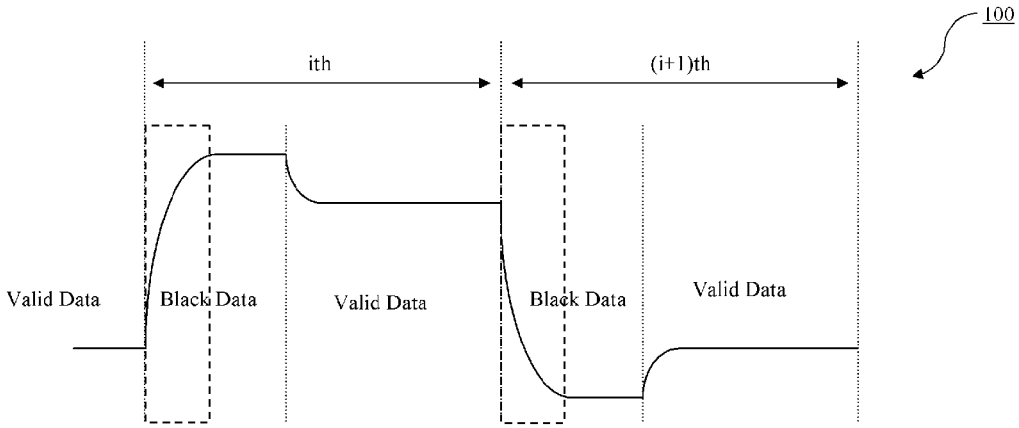
FIG. 1 shows the voltage of the data applied to a continuous horizontal line in the technique of inserting black data and then driving valid data.
Figure 2:
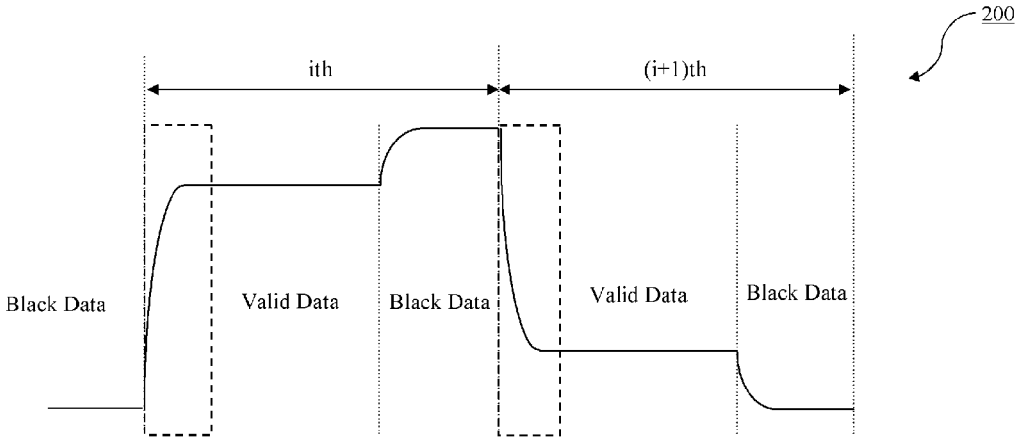
(PRIOR ART) FIG. 2
FIG. 2 shows the voltage of the data applied to a continuous horizontal line in the technique of driving valid data and then inserting black data.

Reference will now be made in greater detail to exemplary embodiments of the invention, examples of which are illustrated in the accompanying drawings. Wherever possible, the same reference numerals will be used throughout the drawings and the description to refer to the same or like parts.

Figure 5:
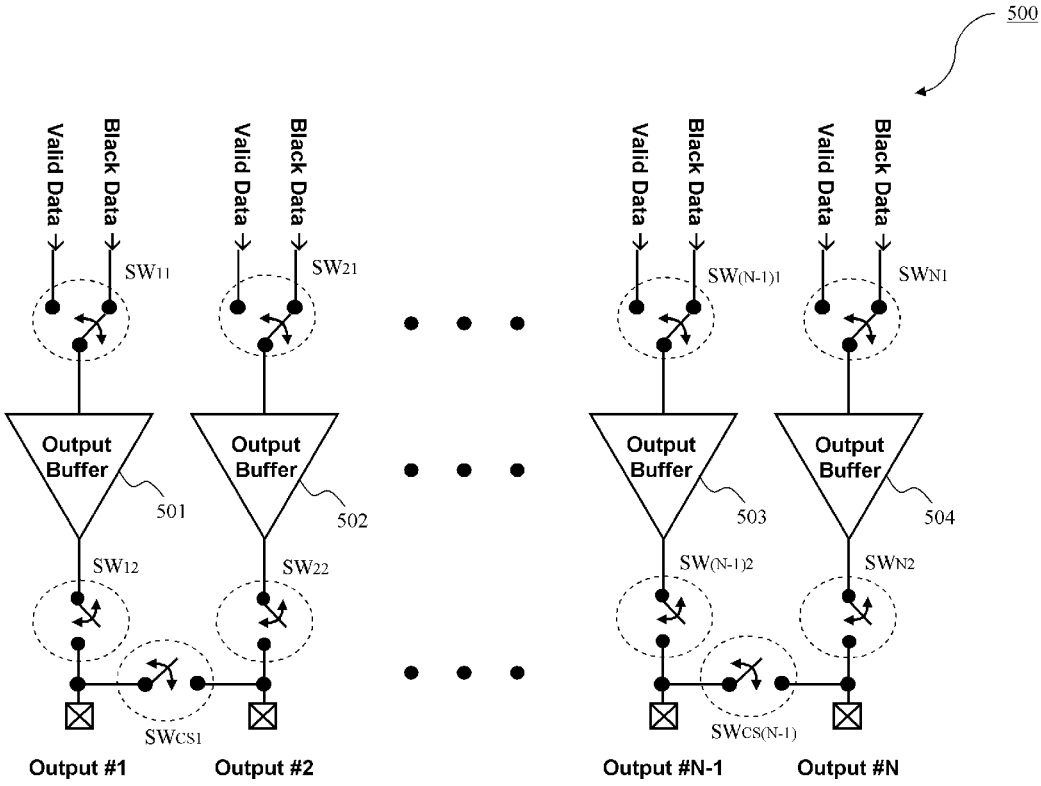
FIG. 5 shows a display driving circuit according to an embodiment of the present invention.

FIG. 5 shows a display driving circuit according to an embodiment of the present invention.

Referring to FIG. 5, the display driving circuit 500 generates driving signals output#1 to output#N corresponding to valid data or black data to transmit them to a display panel (not shown), and includes N data selection switches $SW_{11}$ to $SW_{N1}$, N buffers 501 to 504, N buffer output selection switches $SW_{12}$ to $SW_{N2}$, and multiple charge sharing switches $SW_{CS1}$ to $SW_{CS(N-1)}$, where N is the integer.

The N data selection switches $SW_{11}$ to $SW_{N1}$ select one of the valid data and the black data, and transmit the selected data to the respective buffers 501 to 504. The N buffers 501 to 504 buffer the signal selected by the respective data selection switches $SW_{11}$ to $SW_{N1}$. The N buffer output selection switches $SW_{12}$ to $SW_{N2}$ switch outputs of the buffers 501 to 501N to output the driving signals output#1 to output#N. The charge sharing switches $SW_{CS1}$ to $SW_{CS(N-1)}$ connect the neighboring pairs of the driving signals output#1 to output#N.

Figure 6:
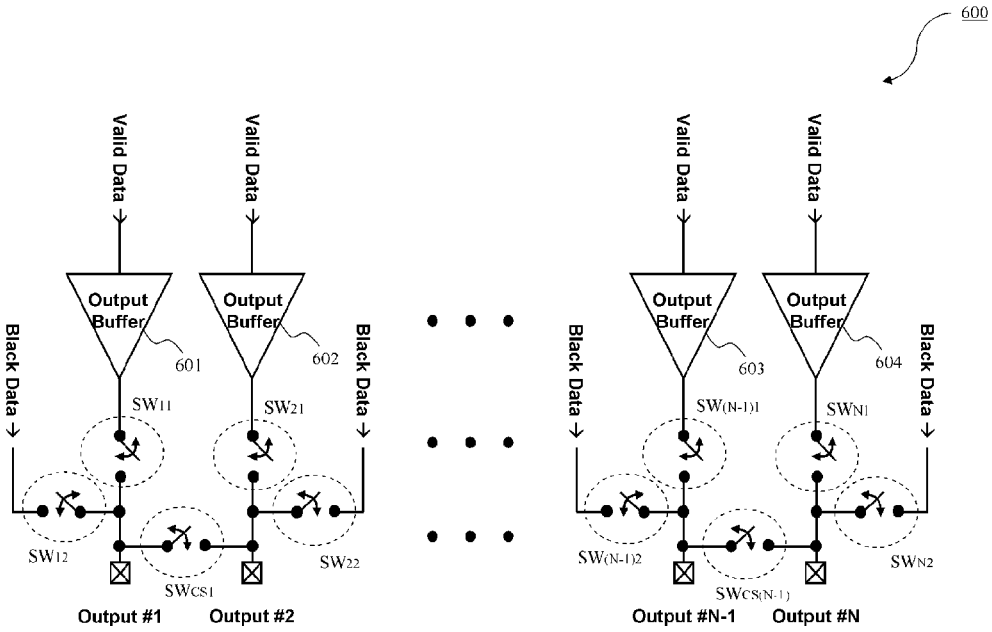
FIG. 6 shows a display driving circuit according to another embodiment of the present invention.

FIG. 6 shows a display driving circuit according to another embodiment of the present invention.

Referring to FIG. 6, the display driving circuit 600 generates driving signals output#1 to output#N corresponding to valid data or black data to transmit them to a display panel (not shown). To this end, the display driving circuit 600 includes N buffers 601 to 604, N buffer output selection switches $SW_{11}$ to $SW_{N1}$, N black data selection switches $SW_{12}$ to $SW_{N2}$, and charge sharing switches $SW_{CS1}$ to $SW_{CS(N-1)}$.

The N buffers 601 to 604 buffer the valid data. The N buffer output selection switches $SW_{11}$ to $SW_{N1}$ switch outputs of the buffers 601 to 604 buffer to output the respective driving signals output#1 to output#N. The N black data selection switches $SW_{12}$ to $SW_{N2}$ switch the black data to output the respective driving signals output#1 to output#N. The charge sharing switches $SW_{CS1}$ to $SW_{CS(N-1)}$ connect the neighboring pairs of the driving signals output#1 to output#N.

Figure 7:
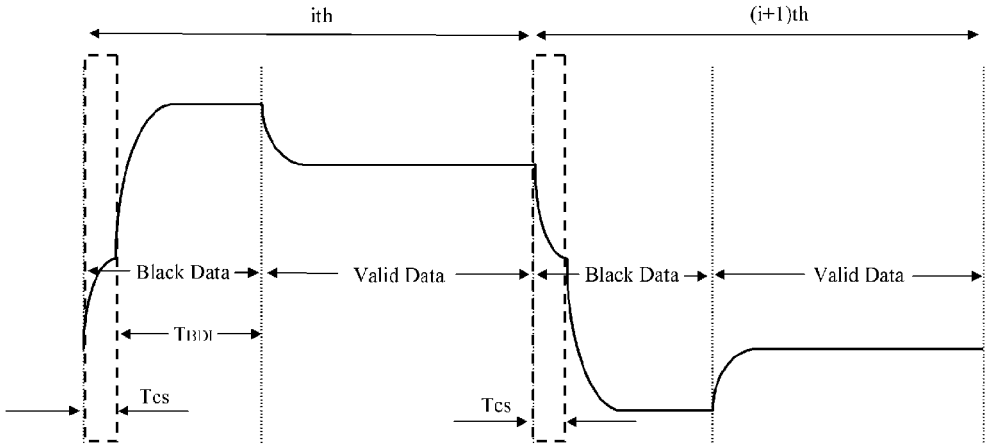
FIG. 7 shows the voltage of the data applied to a continuous horizontal line in a technique of inserting black data and then driving valid data.

FIG. 7 shows the voltage of the data applied to a continuous horizontal line in a technique of inserting black data and then driving valid data.

Figure 3:
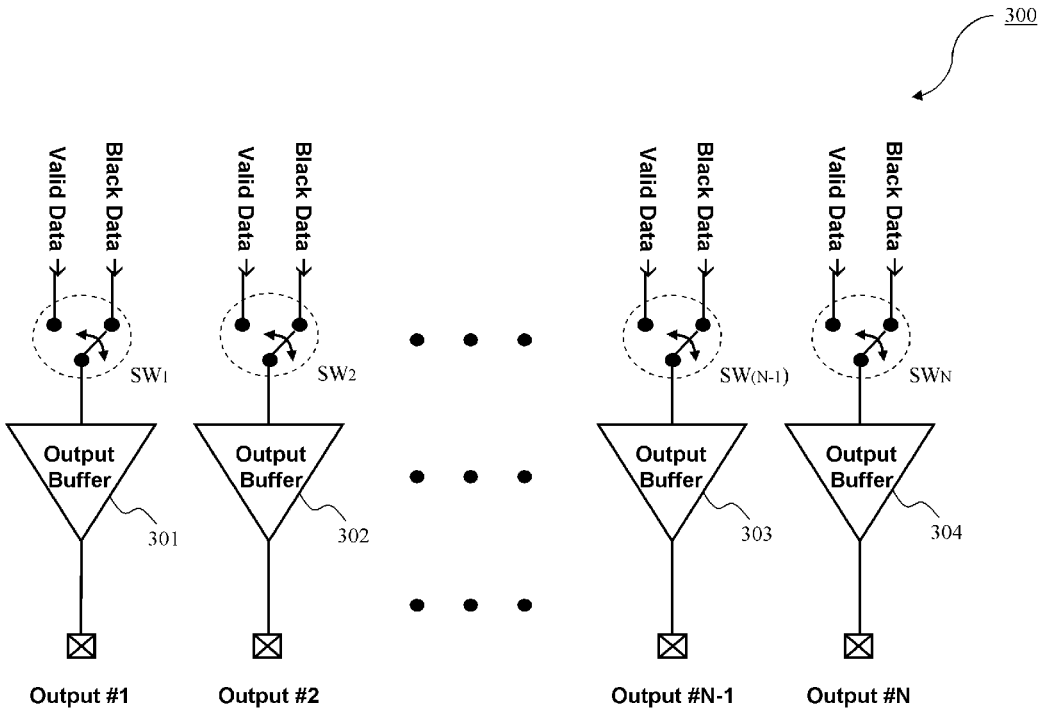
FIG. 3 shows a technique of inserting black data using internal output buffers of a liquid crystal display driving circuit.

Referring to FIG. 7, data transfer sections of i-th and (i+1)-th horizontal lines ith and (i+1)th of the display driving circuit may be each divided into a black data transfer section and a valid data transfer section. The black data transfer section is divided into a charge sharing section $T_{CS}$ and a black data insert section $T_{BDI}$. During the charge sharing section $T_{CS}$, when electric current supplied from the buffers 501 to 504 is adjusted to 0 (zero), consumption electric current of the display driving circuit 500 is minimized. When the charge sharing section $T_{CS}$ is terminated, a constant amount of electric charges is shared to each pixel. Afterwards, during the black data insert section $T_{BDI}$, only the electric current corresponding to voltage required to reach target voltage corresponding to the black data is supplied from the buffers 501 to 504. Thus, the inventive display driving circuit shown in FIG. 7 does not use the electric current as much as that corresponding to the electric charges that are previously shared during the charge sharing section $T_{CS}$, compared to a conventional display driving circuit shown in FIG. 3, so that the consumption electric current is reduced on the whole.

The fact that the second charge sharing section $T_{CS}$ is controlled to have polarity opposite to that of the first charge sharing section $T_{CS}$ has already been described. The other configuration of the second charge sharing section $T_{CS}$ is identical to that of the first charge sharing section $T_{CS}$, and so description thereof will be omitted.

Figure 8:
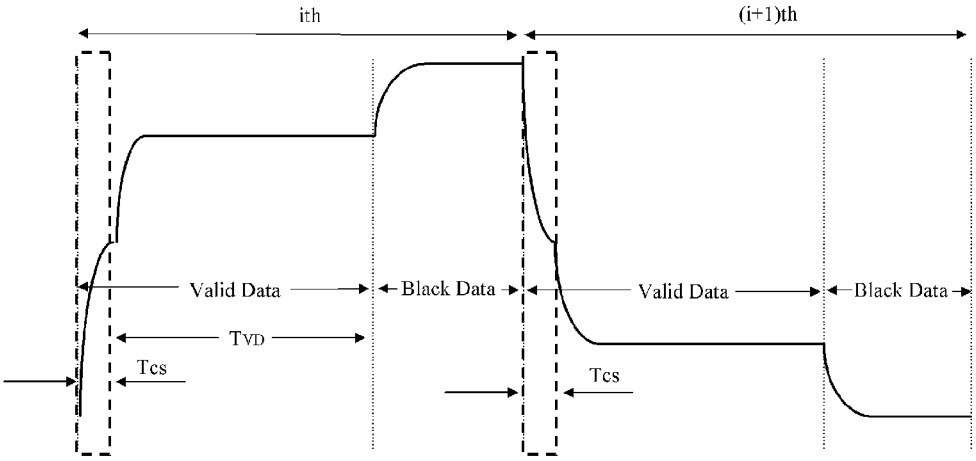
FIG. 8 shows the voltage of the data applied to a continuous horizontal line in a technique of driving valid data and then inserting black data.

FIG. 8 shows the voltage of the data applied to a continuous horizontal line in a technique of driving valid data and then inserting black data.

Figure 4:
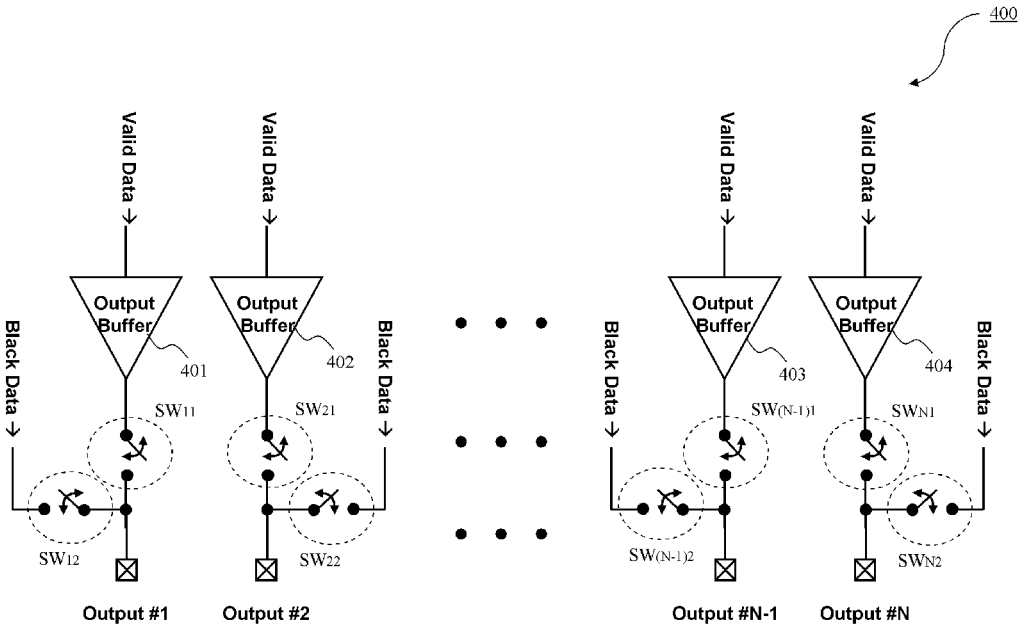
FIG. 4 shows a technique of inserting black data using external output buffers of a liquid crystal display driving circuit.

Referring to FIG. 8, data transfer sections of i-th and (i+1)-th horizontal lines ith and (i+1)th of the display driving circuit may be each divided into a black data transfer section and a valid data transfer section. The valid data transfer section is divided into a charge sharing section $T_{CS}$ and a valid data insert section $T_{VD}$. During the charge sharing section $T_{CS}$, when electric current supplied from the buffers 601 to 604 is adjusted to 0 (zero), consumption electric current of the display driving circuit 600 is minimized. During the black data transfer section after the charge sharing section $T_{CS}$ is terminated, only the electric current required to reach target electric current corresponding to the black data is supplied from black data supply sources (not shown). Thus, the consumption electric current is reduced by the charge sharing section $T_{CS}$ compared to a conventional display driving circuit shown in FIG. 4, so that the consumption electric current is reduced on the whole.

It can be seen that the charge sharing section $T_{CS}$ is included in the black data transfer section in the embodiment shown in FIG. 7, whereas the charge sharing section $T_{CS}$ is included in the valid data transfer section in the embodiment shown in FIG. 8. However, these sections are merely divided for convenience of description. Thus, the charge sharing section $T_{CS}$ may be used as an independent section without belonging to either the black data transfer section or the valid data transfer section.

Now, operation of the display driving circuit according to embodiments of the present invention will be described with reference to FIGS. 5 through 8.

First, the operation of the display driving circuit shown in FIG. 5 will be described with reference to FIGS. 7 and 8. As described above, the display driving circuit employs the technique of inserting the black data and then the valid data, or of inserting the valid data and then the black data in order to remove the residual image.

The terms "transfer" and "insert" will be used below. From the viewpoint of transferring the data to the corresponding pixels, the terms have the same meaning. However, the term "transfer" is to be used for a wider meaning, while the term "insert" is to be used for a relatively narrow meaning. Accordingly, transferring the valid data and inserting the valid data have functionally the same meaning. This is equally applied to transmitting the black data and inserting the black data.

Further, the terms "turn on" and "turn off" are used herein. Here, the term "turn on" means that the switch is closed, and the term "turn off" means that the switch is open.

The technique of inserting the black data and then the valid data will be described with reference to FIGS. 5 and 7.

The black data transfer section in which the black data is transferred to the corresponding pixel is divided into the charge sharing section $T_{CS}$ and the black data insert section $T_{BDI}$.

In the charge sharing section $T_{cs}$, the buffer output selection switches $SW_{12}$ to $SW_{N2}$ are turned off, and the charge sharing switches $SW_{CS1}$ to $SW_{CS(N-1)}$ are turned on. In this manner, since the buffer output selection switches $SW_{12}$ to $SW_{N2}$ are turned off, the electric current flowing to the corresponding pixels to the buffers becomes 0 (zero) while electric charges are shared between the pixels.

In the black data insert section $T_{BDI}$, the data selection switches $SW_{11}$ to $SW_{N1}$ select the black data, and the buffer output selection switches $SW_{12}$ to $SW_{N2}$ are turned on, while the charge sharing switches $SW_{CS1}$ to $SW_{CS(N-1)}$ are turned off. Thus, the corresponding pixel is supplied with part of the electric current corresponding to the black data, which is reduced by that corresponding to the electric charges charged in the charge sharing section.

During the valid data transfer section in which the valid data is transferred to the corresponding pixel, the data selection switches $SW_{11}$ to $SW_{N1}$ select the valid data, and the buffer output selection switches $SW_{12}$ to $SW_{N2}$ are turned on, while the charge sharing switches $SW_{CS1}$ to $SW_{CS(N-1)}$ are turned off.

Continuously, the technique of inserting the valid data and then the black data will be described with reference to FIGS. 5 and 8.

The valid data transfer section in which the valid data is transferred to the corresponding pixel is divided into the charge sharing section $T_{CS}$ and the valid data insert section $T_{VD}$.

In the charge sharing section $T_{CS}$, the buffer output selection switches $SW_{12}$ to $SW_{N2}$ are turned off, and the charge sharing switches $SW_{CS1}$ to $SW_{CS(N-1)}$ are turned on. In the following valid data insert section $T_{VD}$, the data selection switches $SW_{11}$ to $SW_{N1}$ select the valid data, and the buffer output selection switches $SW_{12}$ to $SW_{N2}$ are turned on, while the charge sharing switches $SW_{CS1}$ to $SW_{CS(N-1)}$ are turned off.

During the black data transfer section in which the black data is transferred to the corresponding pixel, the data selection switches $SW_{11}$ to $SW_{N1}$ select the black data, and the buffer output selection switches $SW_{12}$ to $SW_{N2}$ are turned on, while the charge sharing switches $SW_{CS1}$ to $SW_{CS(N-1)}$ are turned off.

Now, the operation of the inventive display driving circuit shown in FIG. 6 will be described.

First, the technique of inserting the black data and then the valid data will be described with reference to FIGS. 6 and 7.

The black data transfer section in which the black data is transferred to the corresponding pixel is divided into the charge sharing section $T_{CS}$ and the black data insert section $T_{BDI}$. In the charge sharing section $T_{CS}$, the buffer output selection switches $SW_{11}$ to $SW_{N1}$ and the black data selection switches $SW_{12}$ to $SW_{N2}$ are turned off, and the charge sharing switches $SW_{CS1}$ to $SW_{CS(N-1)}$ are turned on. In the black data insert section $T_{EDI}$, the buffer output selection switches $SW_{11}$ to $SW_{N1}$ and the charge sharing switches $SW_{CS1}$ to $SW_{CS(N-1)}$ are turned off, and the black data selection switches $SW_{12}$ to $SW_{N2}$ are turned on.

During the valid data transfer section in which the valid data is transferred to the corresponding pixel, the buffer output selection switches $SW_{11}$ to $SW_{N1}$ are turned on, while the black data selection switches $SW_{12}$ to $SW_{N2}$ and the charge sharing switches $SW_{CS1}$ to $SW_{CS(N-1)}$ are turned off.

Subsequently, the technique of inserting the valid data and then the black data will be described with reference to FIGS. 6 and 8.

The valid data transfer section in which the valid data is transferred to the corresponding pixel is divided into the charge sharing section $T_{CS}$ and the valid data insert section T. During the charge sharing section $T_{CS}$, the buffer output selection switches $SW_{11}$ to $SW_{N1}$ and the black data selection switches $SW_{12}$ to $SW_{N2}$ are turned off, and the charge sharing switches $SW_{CS1}$ to $SW_{CS(N-1)}$ are turned on. During the valid data insert section $T_{VD}$, the black data selection switches $SW_{12}$ to $SW_{N2}$ and the charge sharing switches $SW_{CS1}$ to $SW_{CS(N-1)}$ are turned off, and only the buffer output selection switches $SW_{11}$ to $SW_{N1}$ are turned on.

During the black data transfer section in which the black data is transferred to the corresponding pixel, the buffer output selection switches $SW_{11}$ to $SW_{N1}$ and the charge sharing switches $SW_{CS1}$ to $SW_{CS(N-1)}$ are turned off, and only the black data selection switches $SW_{12}$ to $SW_{N2}$ are turned on.

Hereinafter, results of performing computer simulation on the case (FIGS. 9 and 10) in which the black data is inserted using the buffers installed inside the conventional display driving circuit as shown in FIG. 5 and the case (FIGS. 11 and 12) in which the black data is inserted using the buffers installed outside the conventional display driving circuit as shown in FIG. 6 will be described.

Figure 9:
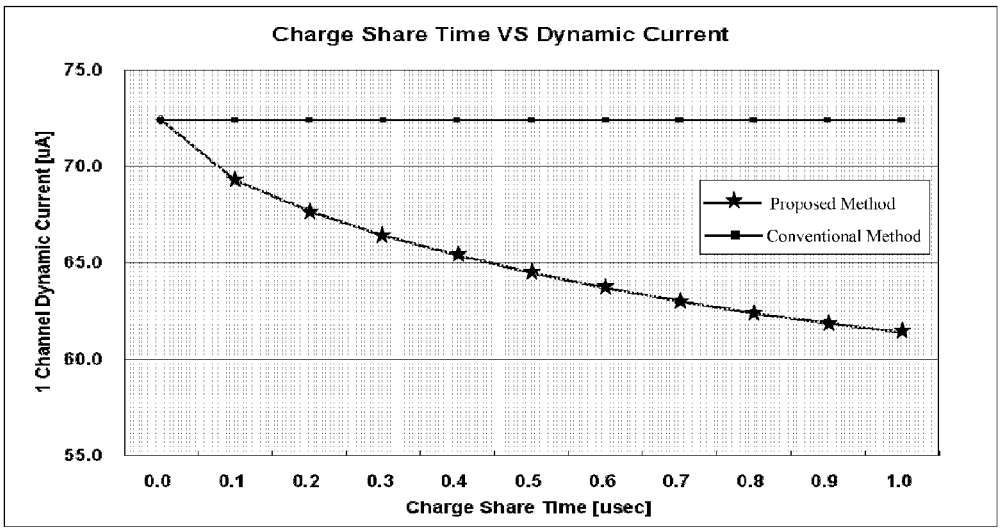
FIG. 9 shows charge share time versus dynamic current in the technique of inserting the black data to then transfer the valid data when the inventive display driving circuit shown in FIG. 5 is used.

FIG. 9 shows charge share time versus dynamic current in the technique of inserting the black data to then transfer the valid data when the inventive display driving circuit shown in FIG. 5 is used.

Figure 10:
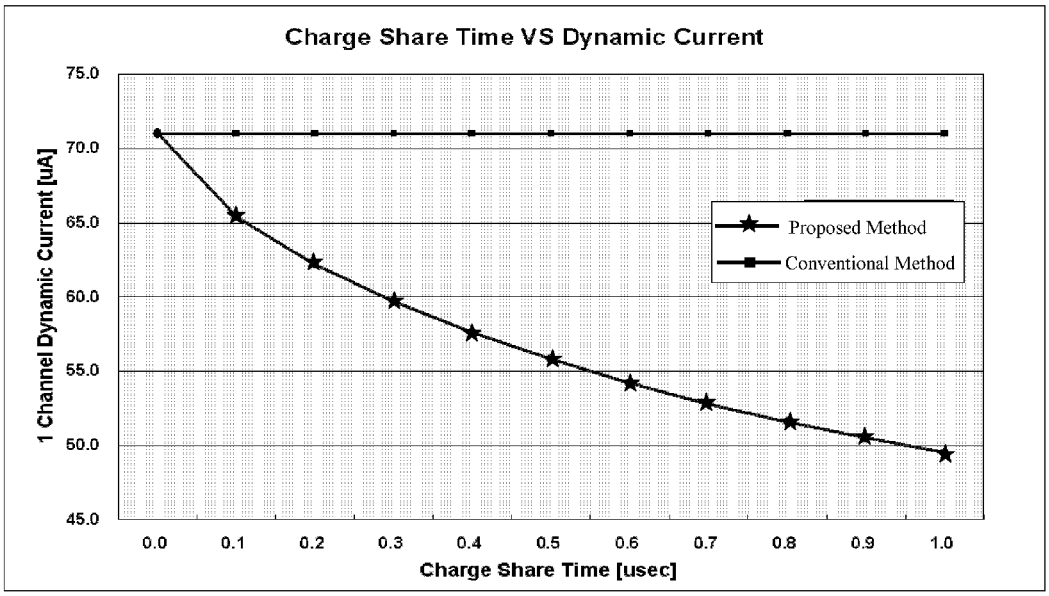
FIG. 10 shows charge share time versus dynamic current in the technique of transferring the valid data to then insert the black data when the inventive display driving circuit shown in FIG. 5 is used.

FIG. 10 shows charge share time versus dynamic current in the technique of transferring the valid data to then insert the black data when the inventive display driving circuit shown in FIG. 5 is used.

Figure 11:
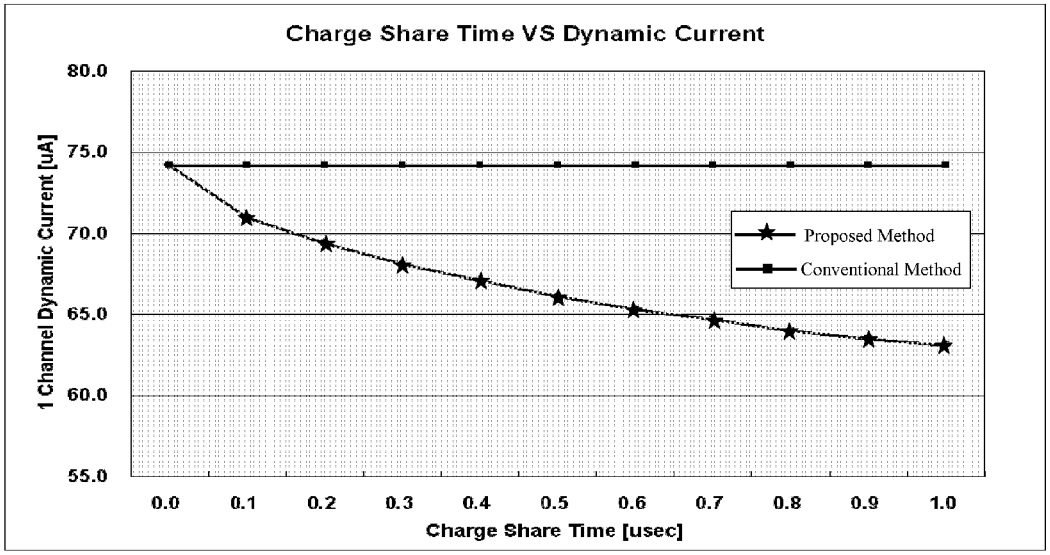
FIG. 11 shows charge share time versus dynamic current in the technique of inserting the black data to then transfer the valid data when the inventive display driving circuit shown in FIG. 6 is used.

FIG. 11 shows charge share time versus dynamic current in the technique of inserting the black data to then transfer the valid data when the inventive display driving circuit shown in FIG. 6 is used.

Figure 12:
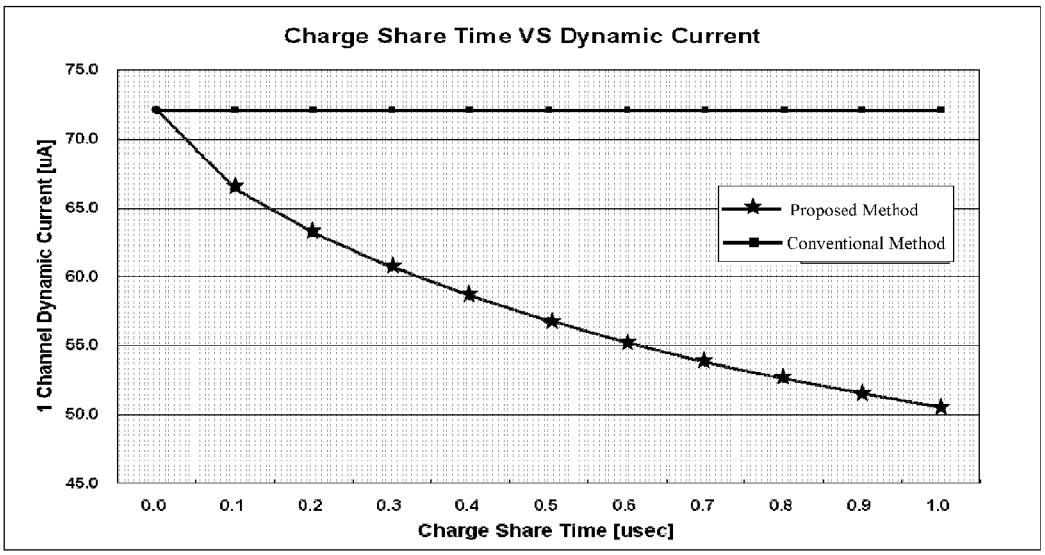
FIG. 12 shows charge share time versus dynamic current in the technique of transferring the valid data to then insert the black data when the inventive display driving circuit shown in FIG. 6 is used.

FIG. 12 shows charge share time versus dynamic current in the technique of transferring the valid data to then insert the black data when the inventive display driving circuit shown in FIG. 6 is used.

In FIGS. 9 through 12, the horizontal axis indicates a charge share time in the unit of micro second (μs), while the vertical axis indicates channel dynamic current in the unit of micro ampere (μA). Here, the channel dynamic current refers to consumption electric current for driving a single pixel of the display.

Referring to FIGS. 9 and 11, in the case of inserting the black data to then transfer the valid data using the buffers installed inside the display driving circuit, the electric charges, which are charged into the pixels in correspondence to the valid data in the previous step, i.e. in the valid data driving step during the charge sharing section $T_{CS}$, are shared to the neighboring pixels, but no charge is supplied from the buffers. As a result, the consumption electric current of the display driving circuit is minimized. Thus, as the charge sharing section $T_{CS}$ increases, the consumption electric current of the display driving circuit is reduced.

Referring to FIGS. 10 and 12, in the case of transferring the valid data to then insert the black data using the buffers installed outside the display driving circuit, for the same reason as in the description of FIGS. 9 and 11, as the charge sharing section $T_{CS}$ increases, the consumption electric current of the display driving circuit is reduced.

Although exemplary embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. A display driving circuit, which generates driving signals corresponding to valid data and black data and transmits the driving signals to a display panel, comprising:

N data selection switches selecting one of the valid data and the black data, where N is the integer;

N buffers buffering the signal selected by the respective data selection switches;

N buffer output selection switches switching outputs of the buffers to output the respective driving signals; and multiple charge sharing switches connecting the neighboring pairs of the driving signals.

2. The display driving circuit as set forth in claim 1, wherein:

the black data is transferred to a corresponding pixel during a black data transfer section that is divided into a charge sharing section and a black data insert section, in the charge share section, the buffer output selection switches are turned off, and the charge sharing switches are turned on, and in the black data insert section, the data selection switches select the black data, and the buffer output selection switches are turned on, while the charge sharing switches are turned off; and the valid data is transferred to a corresponding pixel during a valid data transfer section, in which the data selection switches select the valid data, and the buffer output selection switches are turned on, while the charge sharing switches are turned off.

3. The display driving circuit as set forth in claim 1, wherein:

the valid data is transferred to a corresponding pixel during a valid data transfer section that is divided into a charge sharing section and a valid data insert section, during the charge sharing section, the buffer output selection switches are turned off, and the charge sharing switches are turned on, during the valid data insert section, the data selection switches select the valid data, and the buffer output selection switches are turned on, while the charge sharing switches are turned off, and the black data is transferred to a corresponding pixel during a black data transfer section, in which the data selection switches select the black data, and the buffer output selection switches are turned on, while the charge sharing switches are turned off.

4. A display driving circuit, which generates driving signals corresponding to valid data and black data and transmits the driving signals to a display panel, comprising:

N buffers buffering the valid data, where N is the integer;

N buffer output selection switches switching outputs of the buffers to output the respective driving signals;

N black data selection switches switching the black data output the respective driving signals; and multiple charge sharing switches connecting the neighboring pairs of the driving signals.

5. The display driving circuit as set forth in claim 4, wherein:

the black data is transferred to a corresponding pixel during a black data transfer section that is divided into a charge sharing section and a black data insert section, in the charge sharing section, the N buffer output selection switches and the N black data selection switches are turned off, and the charge sharing switches are turned on, and in the black data insert section, the N buffer output selection switches and the charge sharing switches are turned off, and the N black data selection switches are turned on; and the valid data is transferred to a corresponding pixel during a valid data transfer section, in which the N buffer output selection switches are turned on, while the N black data selection switches and the multiple charge sharing switches are turned off.

6. The display driving circuit as set forth in claim 4, wherein:

the valid data is transferred to a corresponding pixel during a valid data transfer section that is divided into a charge sharing section and a valid data insert section, during the charge sharing section, the buffer output selection switches and the N black data selection switches are turned off, and the charge sharing switches are turned on, and during the valid data insert section, the N data selection switches and the charge sharing switches are turned off, while the buffer output selection switches are turned on; and the black data is transferred to a corresponding pixel during a black data transfer section, in which the buffer output selection switches and the charge sharing switches are turned off, while the N black data selection switches are turned on.

7. The display driving circuit as set forth in claim 1, wherein the charge sharing switches numbers at least N/2.

8. The display driving method, which generates driving signals corresponding to N valid data or N black data and transfers the driving signals to a display by using the display driving circuit according to claim 1, the method comprising:

a valid data inserting step of selecting the valid data between the valid data and the black data and transferring corresponding driving signals to the display;

a charge sharing step of connecting adjacent two driving signals and sharing electric charges charged to at least two pixels; and a black data inserting step of selecting the black data between the valid data and the black data and transferring corresponding driving signals to the display.

9. The method as set forth in claim 8, wherein the driving signals corresponding to the valid data and the black data are not transmitted to the pixels in the charge sharing step.

10. The method as set forth in claim 8, wherein the display is driven by sequential repetition of the charge sharing step, the black data inserting step, and the valid data inserting step, or by sequential repetition of the charge sharing step, the valid data inserting step, and the black data inserting step.

11. The display driving circuit as set forth in claim 4, wherein the charge sharing switches numbers at least N/2.

12. The display driving method, which generates driving signals corresponding to N valid data or N black data and transfers the driving signals to a display by using the display driving circuit according to claim 4, the method comprising:

a valid data inserting step of selecting the valid data between the valid data and the black data and transferring corresponding driving signals to the display;

a charge sharing step of connecting adjacent two driving signals and sharing electric charges charged to at least two pixels; and a black data inserting step of selecting the black data between the valid data and the black data and transferring corresponding driving signals to the display.

* * * * *